United States Patent [19]

Pajak et al.

[11] 4,326,578

[45] Apr. 27, 1982

[54] METHOD FOR MAKING FOUNDRY MOULDS AND CORES

[75] Inventors: Andrzej Pajak; Tadeusz Olszowski, both of Crakow, Poland; Antoni Mazur, deceased, late of Niepolomice, Poland, by Irena Mazur, legal representative; Mariusz Holtzer, Crakow, Poland; Andrzej Marzencki, Crakow, Poland; Adam Jachowicz, Crakow, Poland

[73] Assignee: Instytut Odlewnictwa, Poland

[21] Appl. No.: 122,262

[22] Filed: Feb. 19, 1980

[30] Foreign Application Priority Data

Feb. 16, 1979 [PL] Poland ..... 213514

[51] Int. Cl.[3] ..... B22C 9/12

[52] U.S. Cl. ..... 164/15; 164/520

[58] Field of Search ..... 164/12, 6, 15, 16, 520

[56] References Cited

U.S. PATENT DOCUMENTS

| | | | |
|---|---|---|---|
| 3,512,571 | 5/1970 | Phelps | 164/6 X |
| 4,150,704 | 4/1979 | Hoult | 164/12 |

FOREIGN PATENT DOCUMENTS

| | | | |
|---|---|---|---|
| 6850 | 2/1977 | Japan | 164/16 |
| 1537471 | 12/1978 | United Kingdom | 164/15 |
| 1537743 | 1/1979 | United Kingdom | 164/15 |
| 369972 | 5/1973 | U.S.S.R. | |
| 428843 | 10/1974 | U.S.S.R. | 164/15 |
| 500873 | 7/1976 | U.S.S.R. | |
| 616052 | 7/1978 | U.S.S.R. | 164/6 |
| 659276 | 4/1979 | U.S.S.R. | 164/15 |

OTHER PUBLICATIONS

The "EFFSET" Process of Freeze Moulding, Economic Commission For Europe, Seminar Nov. 28–Dec. 2, 1977.

EFFSET–The Freeze Binding of Sand Molds, Leaflet of BOC Company.

*22 Nations Attend UN Foundry Seminar,* In Foundry M & T, Feb. 1978, pp. 46–50.

*Primary Examiner*—Robert D. Baldwin

*Assistant Examiner*—J. Reed Batten, Jr.

*Attorney, Agent, or Firm*—Michael N. Meller; Anthony H. Handal

[57] ABSTRACT

A method for making foundry moulds and cores where after preparation of the moulds and cores having a sand composition of a low strength up to 0.03 MPa, a cooling medium is introduced into the mould cavity, preferably liquid nitrogen, in an amount to provide hardening of only the surface layer of a required sufficient to reproduce the shape of the mould cavity.

1 Claim, No Drawings

METHOD FOR MAKING FOUNDRY MOULDS AND CORES

It is an object of the present invention to provide a method for making foundry moulds and cores used for casting metals and their alloys.

At present, in order to make a foundry mould or core the sand composition is hardened by means of mechanical packing, or by chemical - possibly also thermal - treatment of the sand components.

A method is also known, among others, from the International Modern Foundry, 1977, No. 4, p. 5, which refers to making foundry moulds and cores and consists in hardening the sand by freezing it through with a liquid gas, passed through the mould made of a mixture of the sand, water and binder. Thus prepared moulds are stacked and kept frozen until pouring them with molten metal.

On the other hand, there is known from the Polish Patent Application No. P-201140 a method consisting in that a foundry mould or core is hardened by blowing it with a freezing liquid or gas, or by placing the said mould or core in an appropriate freezing device at a temperature up to 223 K.

In each one of the methods known at present, the hardened-through sand contains large quantities of the binder, which quite often is toxic, and if it is to be re-used, expensive and laborious process of reclamation is required.

Therefore, it is an object of the present invention to provide a method for making foundry moulds and cores which would enable an application of the freezing process to harden a layer of the sand of a given thickness.

Moreover, the sand used for making foundry moulds and cores and prepared according to the process described in the present application should be re-usable without any necessity of its further reclamation.

And thus, a method for making foundry moulds and cores according to the present invention consists in hardening, within the mould cavity which reproduces the shape of a casting, or on the surface of a core, a layer of the sand of a required thickness, this being obtained by means of introducing into the said mould cavity, or by applying onto the core surface, both mould and core sand being characterized by a low strength, a cooling medium, preferably liquid nitrogen.

The thickness of the hardened sand layer is controlled with the type and quantity of the medium introduced and with the time of cooling.

An application of the method for making foundry moulds and cores according to this invention enables us to reduce an amount of the cooling medium in comparison with the process used so far. In a method according to the invention knocking-out of the sand causes no problems.

Examples of making foundry moulds and cores following a method described herein:

EXAMPLE I

After making a mould weighing 40 kg, prepared in the sand composition containing:
silica sand—100 parts by weight
moulding clay—2 parts by weight
water—2 parts by weight
and being characterized by a compression strength of 0.02 MPa, and after assembling the whole system, liquid nitrogen at a temperature of 77 K and in an amount of 2 l is poured into the mould cavity and is left there for a time of 1.5 minutes until it evaporates completely. The thickness of the hardened layer amounts to 4.5 cm. Compression strength is maintained at a level of 1.0 MPa for a time of 25 minutes. Thus prepared mould is next poured with cast iron.

EXAMPLE II

After making a mould weighing 20 kg, prepared in the sand composition containing:
zircon sand—100 parts by weight
water—3 parts by weight
and being characterized by a compression strength of 0.03 MPa, and after assembling the whole system, liquid nitrogen at a temperature of 77 K and in an amount of 1 l is poured into the mould cavity and is left there for a time of 15 minutes until it evaporates completely. The thickness of the hardened layer amounts to 3.5 cm. Compression strength is maintained at a level of 1.0 MPa for a time of 30 minutes. Thus prepared mould is next poured with cast iron.

We claim:

1. A method of making a foundry mould comprising the steps of: forming a plurality of mould components from a moulding sand composition of a low binder content having a certain content of a liquid component; assembling said mould components to form a mould having a mould cavity therein; pouring liquid gas into the mould cavity in an amount to produce hardening of a layer of said sand to a predetermined thickness only, said layer of the sand being that which will be in contact with molten metal; and leaving said liquid gas in said mould cavity until it completely evaporates.

* * * * *